US005419188A

United States Patent [19]

Rademaker et al.

[11] Patent Number: 5,419,188

[45] Date of Patent: May 30, 1995

[54] REELED TUBING SUPPORT FOR DOWNHOLE EQUIPMENT MODULE

[75] Inventors: Robert A. Rademaker, The Colony; John J. Goiffon, Dallas, both of Tex.

[73] Assignee: Otis Engineering Corporation, Carrollton, Tex.

[21] Appl. No.: 703,287

[22] Filed: May 20, 1991

[51] Int. Cl.[6] ..... E21B 47/00

[52] U.S. Cl. ..... 73/151; 367/35

[58] Field of Search ..... 73/151, 152; 166/255, 166/302; 385/101, 107, 108; 340/854.7, 854.9; 358/99, 100; 367/35, 86, 911; 181/105

[56] References Cited

U.S. PATENT DOCUMENTS

| | | | |
|---|---|---|---|
| 2,632,801 | 3/1955 | Donaldson | 358/100 |
| 2,849,530 | 8/1958 | Fleet | 358/100 |
| 2,852,600 | 9/1958 | Jenkins, Jr. | 358/100 |
| 2,912,495 | 11/1959 | Moon et al. | 358/100 |
| 3,066,969 | 12/1962 | Camac | 358/100 |
| 3,075,113 | 1/1963 | Soar | 358/100 |
| 3,114,799 | 12/1963 | Waters et al. | 358/100 |
| 3,320,359 | 5/1967 | Ikegami | 358/87 |
| 3,825,078 | 7/1974 | Heilhecker et al. | 175/57 |
| 3,825,079 | 7/1974 | Heilhecker | 175/57 |
| 3,984,627 | 10/1976 | Galerne | 178/6.8 |
| 4,098,342 | 7/1978 | Robinson et al. | 166/315 |
| 4,162,400 | 7/1979 | Pitts, Jr. | 340/854.7 |
| 4,229,762 | 10/1980 | Healy | 358/100 |
| 4,238,158 | 12/1986 | Sington | 356/241 |
| 4,630,243 | 12/1986 | MacLeod | 367/82 |
| 4,665,281 | 5/1987 | Kamis | 174/102 R |
| 4,687,293 | 8/1987 | Randazzo | 350/96.23 |
| 4,711,122 | 12/1987 | Angehrn et al. | 73/151 |
| 4,766,577 | 8/1988 | Clerke et al. | 367/911 |
| 4,780,858 | 10/1988 | Clerke | 367/35 |
| 4,829,488 | 5/1989 | Seigfried, II | 367/69 |
| 4,855,820 | 8/1989 | Barbour | 358/100 |
| 4,924,870 | 5/1990 | Wlodarczyk et al. | 128/667 |
| 4,938,060 | 7/1990 | Sizer et al. | 73/151 |
| 4,941,349 | 7/1990 | Wolkow et al. | 73/151 |
| 4,964,685 | 10/1990 | Savitsky et al. | 350/96.2 |
| 4,971,147 | 11/1990 | Thomeer | 166/65.1 |
| 5,000,539 | 3/1991 | Gareis | 350/96.23 |
| 5,007,697 | 4/1991 | Chadna et al. | 350/96.15 |
| 5,140,319 | 8/1992 | Riordan | 358/100 |

FOREIGN PATENT DOCUMENTS

| | | |
|---|---|---|
| 0112148 | 12/1983 | European Pat. Off. . |
| 1590563 | 3/1978 | United Kingdom . |
| 2126372 | 3/1983 | United Kingdom . |

OTHER PUBLICATIONS

U.S. Patent Application Serial No. 07/540,573, filed Jun. 15, 1990, and assigned to Westech Geophysical, Inc.

*Primary Examiner*—Tom Noland
*Assistant Examiner*—Michael J. Brock
*Attorney, Agent, or Firm*—Johnson & Wortley; H. Dale Langley, Jr.

[57] ABSTRACT

A system for the inspection of a well borehole and the formation around the borehole. The system includes a sealed tubing at the lower end of which is mounted a fiberoptic telemetry module which receives various sensor modules for transmissions of sensed information to the surface. The modular telemetry link and sensor include fluid passageways through which fluid pumped from the surface down the sealed tubing may pass to create a region of optically clear and/or acoustically homogenous fluid in the borehole in the vicinity of the modular telemetry link and sensor. The passage of fluid through the passageways in the modular equipment may also serve to cool the circuits thereof.

4 Claims, 4 Drawing Sheets

REELED TUBING SUPPORT FOR DOWNHOLE EQUIPMENT MODULE

CROSS REFERENCE TO RELATED APPLICATIONS

This application contains subject matter related to U.S. patent application Ser. No. 07/702,827, now U.S. Pat. No. 5,275,038, (attorney docket no. 12609-0038) entitled "Downhole Reeled Tubing Inspection System With Fiberoptic Cable", filed on even date herewith and assigned to the assignee of the present invention Such application and the disclosures therein are hereby incorporated by reference herein.

BACKGROUND OF THE INVENTION

1. Field of the Invention

The invention relates to downhole inspection and treatment systems and, more particularly, to a system for enabling the concurrent injection of fluid into a borehole and the performance of axillary downhole activities such as inspection and/or measurement. The invention may be practiced during maintenance and servicing of oil, gas, geothermal and injection wells.

2. History of the Prior Art

In the drilling and production of oil and gas wells, it is often necessary to obtain at the surface information concerning conditions within the borehole. For example, tools and other objects may become lodged in the borehole during the drilling of a well. Such objects must be retrieved before drilling can continue. When the removal of foreign objects from a borehole is undertaken, known as "fishing", it is highly desirable to know the size, position, and shape of the obstructing object in order to select the proper fishing tool to grasp the object and remove it from the borehole. Such information is very difficult to obtain because of the hostile downhole environment within a borehole filled with opaque drilling fluid.

In the operation and/or periodic maintenance of producing injection wells, it is also frequently necessary to obtain information about the construction and/or operating condition of production equipment located downhole. For example, detection of the onset of corrosion damage to well tubing or casing within a borehole enables the application of anti-corrosive treatments to the well. Early treatment of corrosive well conditions prevents the highly expensive and dangerous replacement of corrosion damaged well production components. Other maintenance operations in a production well environment, such as replacement of various flow control valves or the inspection of the location and condition of casing perforations, make it highly desirable for an operator located at the surface to obtain accurate, realtime information about downhole conditions. The presence of production fluids in the well renders accurate inspection very difficult.

Various techniques have been proposed for obtaining at the surface information about the conditions within a borehole. One approach has been to lower an inspection device, such as an optical or acoustical sensor positioned on the end of section of reeled tubing, into the borehole and produce a slug or "bubble" or optically transparent and/or acoustically homogenous fluid within the borehole to enable the accurate inspection by the inspection sensor attached to the lower end of the tubing. Such a system is shown in U.S. Pat. No. 4,938,060 to Sizer et al and assigned to the assignee of the present invention. This system is a major improvement over prior art inspection systems. However, in the application of certain techniques taught in the Sizer et al patent it is desirable to provide other types of downhole sensing devices within a region of an injected fluid to enhance the accuracy with which such sensor measurements are taken. For example, it may be desirable to inject a pill or slug of corrosion inhibiting material into a borehole having an extremely caustic environment in order to simply enable the measurement of certain parameters within that borehole without the destruction of the measuring instruments or sensors.

In addition, in the case of optical inspection sensors of the type shown in the Sizer et al patent, it is also desirable to provide a means for simultaneously cooling the downhole sensor equipment as well as injecting the optically transparent and/or acoustically homogenous fluid within the borehole which enhances the observation and inspection functions performed by the equipment.

It would be improvement in downhole inspection systems if an optically clear and/or acoustically homogenous fluid could be directly injected into the borehole in a zone where a multiplicity of different inspection devices could be positioned for use. In addition, it would be desirable to provide such an injection system which also simultaneously provides a cooling function within the sensor equipment and, ejects the fluid at a location with respect to the sensor which enhances the inspection activity.

SUMMARY OF THE INVENTION

The present invention is directed toward an improved method and apparatus for sensing conditions within a borehole.

In one aspect, the system of the present invention provides a fluid conduit extending from the surface of a borehole to a location within the borehole at which a sensing device is desired to be positioned. The lower end of the conduit has mounted thereto a fiberoptic telemetry link for the transmission of information up a fiberoptic cable extending through the interior of the fluid conduit. At the surface there is connected to the conduit a means for a pumping a selected quantity of fluid down the conduit from the surface and out into the borehole in the zone of monitoring. A selected type of sensor may be connected to the lower end of the fiberoptic transmitter to enable the transmission of information back uphole through the fiberoptic telemetry link while at the same time fluid is being pumped down the conduit into the region of the borehole near the end of the tubing.

In another aspect, a television camera is connected to the modular fiberoptic telemetry link and the fluid pumped down the conduit includes a optically transparent and/or acoustically homogenous fluid to allow accurate inspection of conditions within the borehole by the television camera.

In still another aspect, the invention includes a system for monitoring conditions in and around a borehole in which a length of conduit extends from the surface through the borehole down to the zone where the monitoring is to occur. A telemetry link module is mounted on the lower end of the conduit for transmitting information to the surface and the telemetry link module has means positioned at its lower end for receiving a sensor module and coupling information produced by the sensor into the telemetry link. A communications cable is connected between the telemetry link and the surface extending through the length of conduit and a fluid is pumped from the surface down the conduit into the monitoring region adjacent the telemetry link which provides a medium conducive to accurate inspection of the conditions within the borehole by the sensor.

In a still further aspect of the invention there is included a system for inspecting the interior of a borehole having a reeled tubing unit including a reel with a length of tubing wound thereon and an injector for inserting the tubing on the reel down into a borehole to a location at which inspection is to occur. A telemetry link module is mounted to the end of the reeled tubing to be inserted into the borehole and the telemetry link is capable of receiving a sensor coupled to the lower end thereof and receiving data from the sensor and transmitting it to the surface. A fiberoptic cable is connected between the telemetry link module and monitoring equipment at the surface. A pump is connected to the end of the reeled tubing located at the surface for supplying pressurized optically transparent and/or acoustically homogenous fluid to the reeled tubing. The fluid is passed through the telemetry link module to cool the circuits thereof and then to the interior of said borehole to provide an optically clear and/or acoustically homogenous region within the borehole in the region of the sensor which enables the sensor coupled to the telemetry link to accurately inspect physical conditions within the borehole.

BRIEF DESCRIPTION OF THE DRAWING

For a more detailed understanding of the present invention and for further objects and advantages thereof, reference can now be had to the following description taken in conjunction with the accompanying drawing, in which.

DETAILED DESCRIPTION OF THE PRESENT INVENTION

Figure 1:
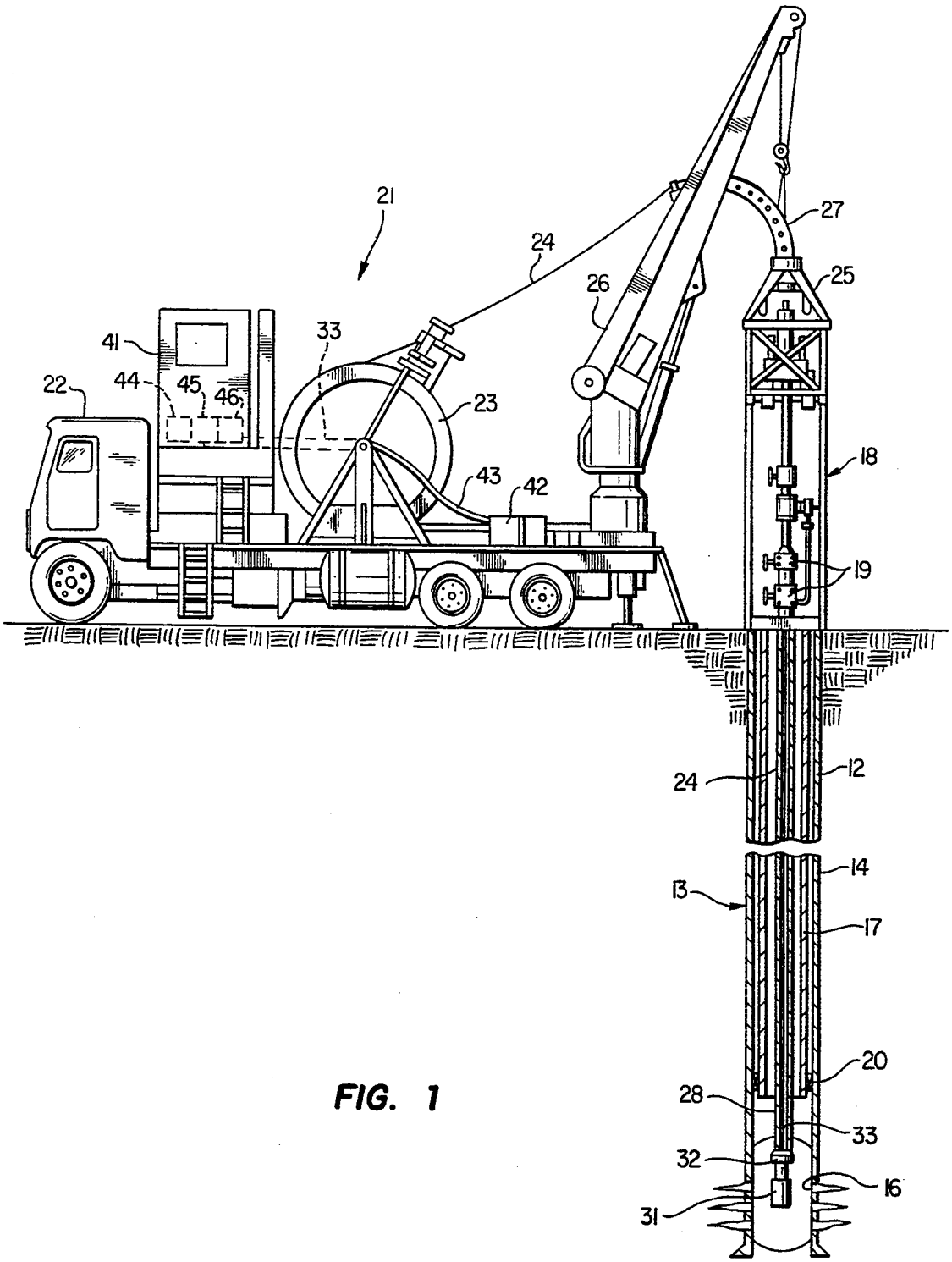
FIG. 1 is an illustrative schematic drawing, partially in elevation and partially in cross-section, showing a borehole inspection system.

Referring to FIG. 1, there is shown a borehole 12 forming part of a completed production well 13 which includes a casing 14 extending from the surface to the production zone 15 of the well. The casing includes a plurality of perforations 16 formed in the wall thereof to allow the influx of production fluids from the producing formation into the borehole for removal at the wellhead. A production packer 20 is positioned between the tubing 17 and the casing 14 above the production zone 15.

A string of production tubing 17 extends from the wellhead production completion equipment 18, known as a "christmas tree", to allow the fluids flowing into the casing 14 from the formation to be received at the surface for collection as production fluids from the well. The various valves 19 at the wellhead 18 control the flow of production fluids brought to the surface through the tubing 17.

Also shown in FIG. 1 is an item of production well maintenance equipment 21 known as a reeled tubing unit. This system comprises a truck 22 onto a bed of which is mounted a large mechanically operated reel 23 upon which is wound a continuous length of metal tubing 24 capable of withstanding relatively high pressures. The tubing 24 is slightly flexible so as to be able to allow coiling of the tubing onto the reel 23. A reeled tubing injector unit 25 is suspended over the wellhead 18 by a hydraulic crane 26 and is directly attached to the wellhead. The injector 25 includes a curved guide way 27 and a hydraulic means for injecting the reeled tubing 24 down into the well tubing 17 while the well remains under production pressure. A sufficient length of tubing 24 is inserted into the well that the lower end of the reeled tubing 28 extends out the lower end of the production tubing 17 into the region of the borehole inside the casing 14. The production zone 15 is deemed, for purposes of illustration, to be the borehole inspection zone of interest. An inspection sensor 31 is shown positioned in that region.

Attached to the lower end of the reeled tubing 28 is a downhole inspection sensor assembly 31 and a fluid injection nozzle 32 which is in fluid communication with the inside of the reeled tubing 24. A fiberoptic and electrical cable 33 is connected to the sensor 31 and extends longitudinally up the interior of the reeled tubing 24 to the receiving and control equipment located at the surface adjacent the wellbore. The tubing 24 conducts injection fluid to a precise location within the borehole as well as protects the length of fiberoptic communication cable 33 extending between the inspection sensor 31 and the surface.

The reeled tubing unit 21 also carries an operator control housing 41 and a pair of pumps 42 connected to the upper end 43 of the reeled tubing 24 to supply pressurized fluids into the tubing from the surface. The pumps 42 are connected to a supply of fluid (not shown). A pump control console 44 is located within the operator housing 41 and adapted to control the operation of the pumps 42. The upper end of the fiberoptic cable 33 extending longitudinally along the interior of the reeled tubing 24 is connected to a sensor control unit 45 and to a sensor monitor 46 both of which are located within the operator housing 41.

The sensor assembly 31 may include, for example, a television camera or an acoustical transmitter/receiver.

Alternatively, other types of inspection devices such as conventional photographic cameras or high energy radiation sensors might also be employed for particular applications. In the event that a television camera is used as the sensor, the downhole assembly 31 would also include a lighting system and the fiberoptic cable 33 is used to carry both electrical power and control signals downhole to power the lights and camera and control the camera as well as video signals back uphole from the camera to the sensor control unit 45 and television monitor 46. In addition, the sensor control unit 45 also includes a video recording system for providing a permanent record of the borehole inspection signal produced by the television camera.

Figure 2:
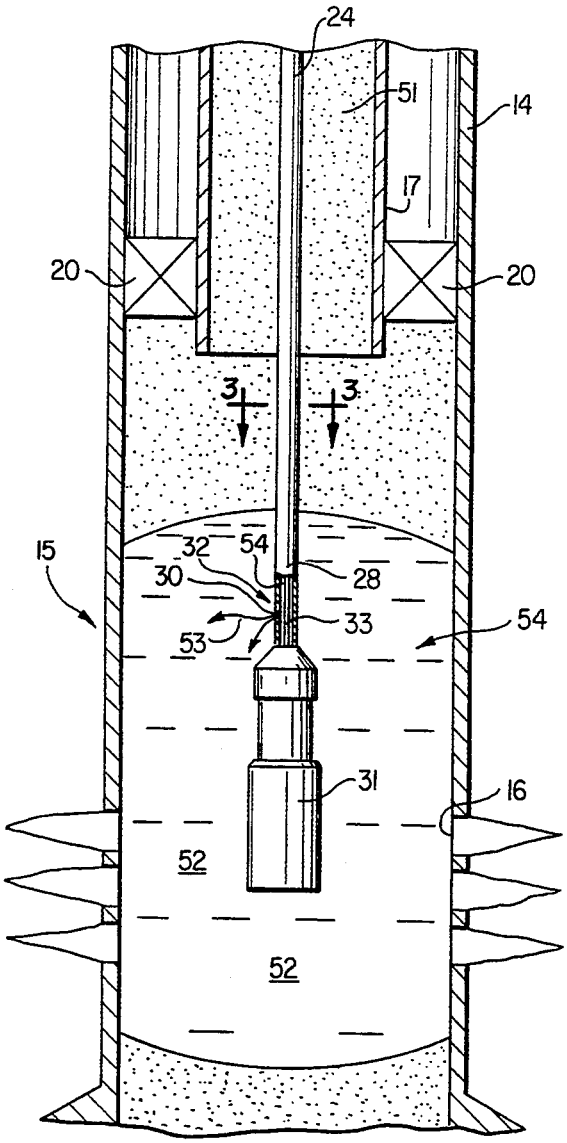
FIG. 2 is an elevational cross-section view of the lower end of the tubing showing the sensor of the inspection system shown in FIG. 1 and the zone of inspection within the borehole.

Referring now to FIG. 2, there is shown an enlarged cross-section view of the lower end 28 of the reeled tubing 24 and the borehole inspection zone 15. The lower end of the production tubing 17 is sealed on the outside against the inner wall of the casing 14 by means of the production packer 20. Production fluids 51 which flow into the casing 14 through the perforations 16, travel up the tubing 17 toward the wellhead. The production fluids 51 generally comprise oil, salt water, and other opaque and frequently non-homogenous fluids.

As discussed above in connection with FIG. 1, the pumps 42 are connected to the upper end 43 of the reeled tubing 24 and to one or more supplies of fluid. From the surface, an optically clear and/or acoustically homogenous fluid 52, from one of the sources connected to one of the pumps 42, is pumped down the reeled tubing 24 in the direction downhole and toward the nozzle 32 in the lower end 28 of the reeled tubing. This fluid forms an isolated zone or "pill" 54 of optically transparent and/or acoustically homogenous fluids 52 in the region of the inspection sensor 31. This enables the sensor 31 to accurately inspect the interior conditions within the borehole. For example, with the injection of pill 54 of clear fluid the condition of the inner side walls of the casings 14 can be optically and/or acoustically inspected without any obstruction from the opaque, non-homogenous borehole fluids 51 normally present within the borehole. Signals produced by the sensor 31 are relayed up the fiberoptic cable 33 to the sensor monitoring and control unit 45 within the operator housing 41 located at the surface.

The fluid 52 which is forced down the reeled tubing 24 under pressure by means of pumps 42 located at the surface, may comprise a number of different fluids depending upon the inspection sensor selected for the particular application and operating conditions. For example, a clear fluid media such as water, nitrogen, light hydro-carbons, natural gas, $CO_2$, and many others may be acoustically homogenous and optically clear and thus provide a suitable medium for careful and accurate inspection of the downhole conditions by the sensor.

Figure 3:
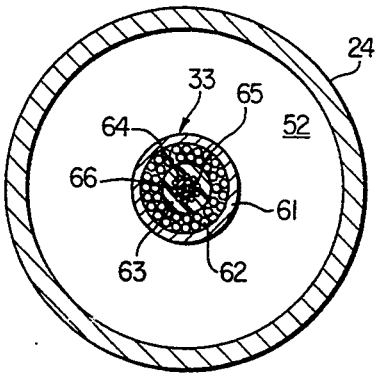
FIG. 3 is a cross-section view taken along the lines 3—3 of FIG. 2.

Referring next to FIG. 3, there is shown a cross-section view about the lines 3—3 of FIG. 2 which shows the reeled tubing 24 together with the axially extending fiberoptic cable 33 which extends the length of the reeled tubing between the surface control equipment and the sensor 31. The optically clear and/or acoustically homogenous fluid 52 flows downhole in the annular region between the outside of the fiberoptic cable 33 and the inside wall of the reeled tubing 24. The fiberoptic cable 33 comprises a plurality of concentric layers including an outer metal shield 61 preferably formed of corrosion resistant material such as stainless steel, protects the cable from the corrosive environment in the event fluid is used within the reeled tubing from which such protection is required. The outer metal casing or shield 61 also provides longitudinal strength to the cable 33 and enables longer lengths of it to be employed for deeper operation. Next, within the outer shield 61 is a plurality of layers of stranded metal filaments 62 which provide both longitudinal strength to the cable 33 as well as an electrical conductor in electrically conductive engagement with the outer metal shield 61 as one of a pair of conductors extending the length of the cable 33. The next layer within the stranded conductor 62 is a layer of insulation material 63 which separates the conductive strand 62 from a ring of smaller metal strands 64 which form a second conductor extending the length of the cable 33. Next within the ring of metal conductors 64 is an insulative layer 65 which surrounds and protects an inner optical fiber core 66. The optical fiber core 66 may include either a single fiber or a plurality of separate fibers through which information may be transmitted in accordance with well accepted optical transmission techniques including both analog signal modulation as well as digital modulation. The cable 33 shown in FIG. 3 within the length of reeled tubing 24 is capable of carrying information along the fiberoptic strand 66 as well as by means of the pair of electrical conductors comprising the outer conductive strands 62 and the inner conductive strands 64 which together form a pair of isolated electrical conductors.

Figure 4:
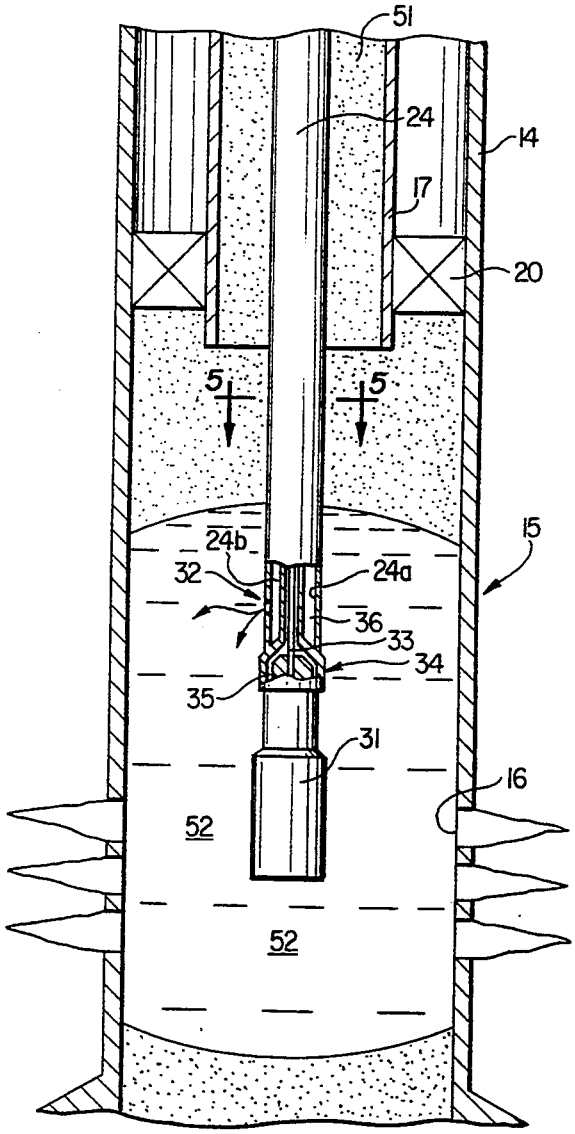
FIG. 4 is an elevational cross-section view of the lower end of the tubing partially cut-away showing an alternative embodiment of tubing construction for the inspection system shown in FIG. 1.

Referring next to FIG. 4, there is shown an enlarged, cross-section view of the lower end 28 of an alternate embodiment of the system of FIG. 2 containing a pair of concentric reeled tubings extending into the borehole inspection zone 15. The lower end of the production tubing 17 is sealed on the outside against the inner wall of the casing 14 by means of the production packer 20. Production fluids 51 which flow into the casing 14 through the perforations 16, travel up the tubing 17 toward the well head. As in the embodiment of FIG. 2, discussed above, the pumps 42 are connected to the upper end 43 of the concentric reeled tubings 24 and to a pair of fluid supplies. The concentric reeled tubings 24 comprise an outer larger diameter tubing **24*a* and an inner smaller diameter tubing 24*b* which extends axially along and within the outer tubing 24*a*. The fluid flowing in the annular region between outer tubing 24*a* and inner tubing 24*b* may exit through nozzle 32 in the lower end 28 of the reeled tubing. The sensor 31 is coupled to the lower end of the tubings 24 by means of a coupling 34 which includes an inner fluid flow passageway 35 in fluid communication with the interior of the inner tubing 24*b*. Thus, from the surface an optical clear and/or acoustically homogenous fluid 52 drawn from a first source connected to a first one of the pumps 42, is pumped down the reeled tubing 24 in the annular space between the outer tubing 24*a* and the inner tubing 24*b* toward the nozzle 32 in the lower end of the reeled tubing. This fluid forms the isolated zone or "pill" 54 of optically transparent and/or acoustically homogenous fluid 52 in the region of the inspection sensor 31. In addition, the special purpose fluid 36 is pumped from the surface from a second source connected to the pumps 42 down the second passageway of the reeled tubing comprising the confines of the inner tubing 24*b* and through the fluid passages 35 in the coupling 34 and into connecting fluid passages 35 located within the sensor 31. The second fluid 36 flowing down the inner tubing 24*b* may comprise a cooling fluid such as liquid nitrogen or water used to cool the circuitry of the sensor 31 and enable it to operate in an efficient manner in the often high temperature and hostile borehole environment. Similarly, the fluid down the inner tubing 24***b* may alternatively comprise other fluids such as corrosion inhibitors which could be used to enshroud the exterior of the sensor 31 and prevent corrosion thereof while it is present in extremely hostile and corrosive environments within the borehole.

Figure 5:
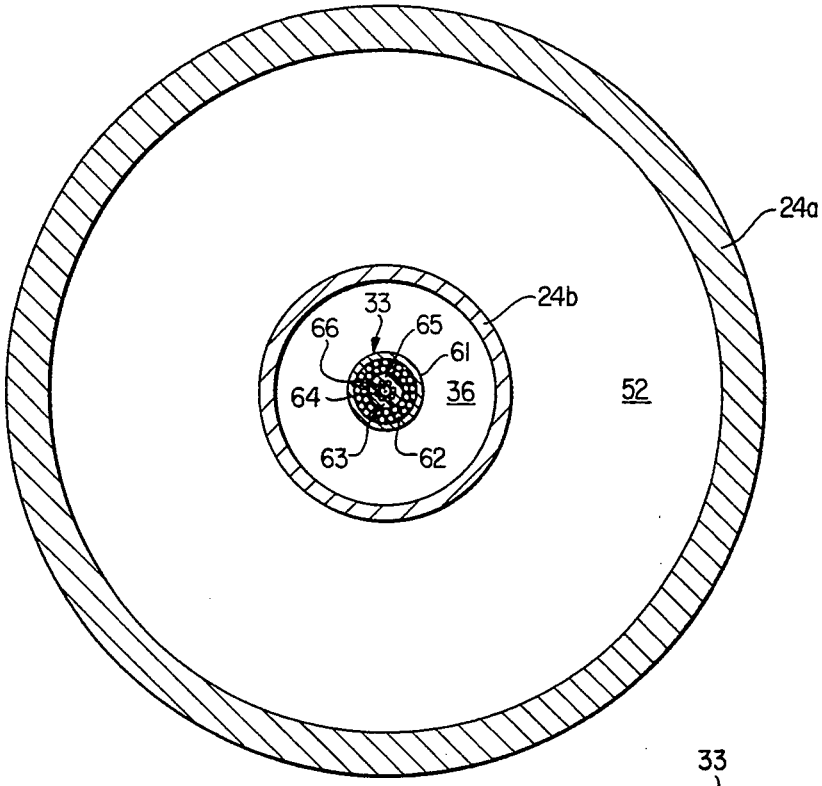
FIG. 5 is a cross-section view taken about the lines 5—5 of FIG. 4.

Referring next to FIG. 5, there is shown a cross-sectional view taken about lines 5—5 of FIG. 4 which illustrates the outer concentric tubing 24*a* within which is positioned the smaller inner tubing 24*b*. The optically transparent and/or acoustically homogenous fluid 52 is pumped down the annular region between the outer tubing 24*a* and the inner tubing 24*b* while the second fluid 36 is pumped down the inner tubing 24*b* between the inner wall of that tubing and the outer wall of the fiberoptic cable 33. The cable 33 may be similar in construction to the cable illustrated and discussed above in connection with FIG. 3 and include an outer metal shield 61 within which is contained a circular array of stranded conductive metal filaments 62, forming one conductor of a pair within the cable 33. In addition, within the conductor 62 is an insulative layer 63 within which is contained another ring of stranded filaments 64 forming the second conductor of the conductive pair within the cable 33. Inside the ring of conductor 64 is another insulative layer 65 which houses a fiberoptic filament 66 for conducting information from the inspection sensor to the receiving equipment uphole.

Figure 6:
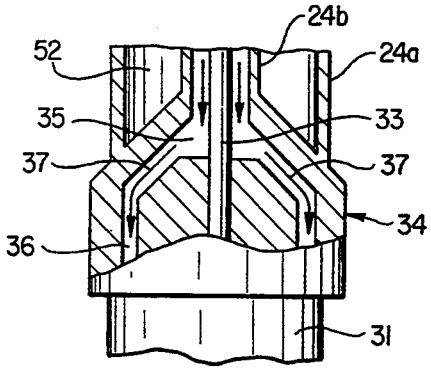
FIG. 6 is an enlarged view of the partially cut-away portion shown in FIG. 4.

Referring now to FIG. 6, there is shown an enlarged view of the coupling 34 located between the sensor 31 and the concentric tubings 24*a* and 24*b*. As discussed above, the optically transparent and/or acoustically homogenous fluid 52 is pumped downhole in the first passageway comprising the annular space between the outer tubing 24*a* and the inner tubing 24*b*. The second fluid 36 is pumped downhole through the second passageway comprising the inside of the inner tubing 24 and the annular space between the inner wall thereof and the outer wall of the fiberoptic cable 33. The fluid 36 flows through the fluid flow passageways 35 in the direction of the arrows 37 and provides an additional fluid that performs functions such as cooling, corrosion inhibition, treatment, etc.

Figure 7:
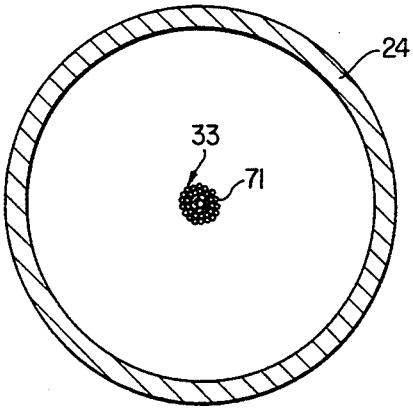
FIG. 7 is a cross-section view taken along the lines 3—3 of FIG. 2 and shows an alternative embodiment of a fiberoptic cable used in the invention to that shown in FIG. 3.

Referring next to FIG. 7, there is shown a cross-section diagram of an alternative embodiment of fiberoptic cable 33 which can be used within the interior of the reeled tubing as shown in FIGS. 2 and 3. In this embodiment of the fiberoptic cable, the reeled tubing 24 contains within it a cable 33 having an outer layer of stranded metal conductors 71 which are spirally wrapped for added strength within which is contained a plurality of additional layers.

Figure 8:
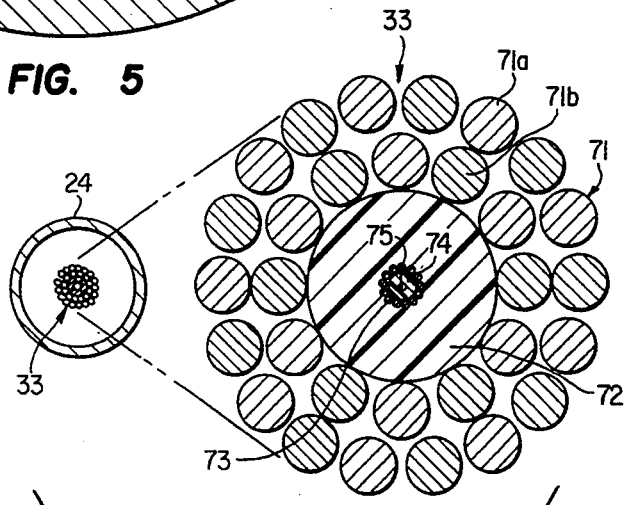
FIG. 8 is a illustrative, enlarged view of the fiberoptic cable shown in FIG. 7.

Referring to FIG. 8, there is shown an enlarged view of the cable and tubing of FIG. 7. In FIG. 8, it can be seen how the outer layer of stranded cabling comprising an outer ring of conductors 71*a* and an inner concentric ring of conductors 71*b* is provided for beth strength of the cable as well as a conductive layer comprising one conductor of a pair of electrical conductors within the cable 33. In the interior of the stranded conductor 71 there is a layer of insulation, which may be formed of plastic, rubber or other suitable insulative materials and within the insulative layer is another ring of stranded electrical conductors 73 each smaller in diameter than each of the conductors in the outer layer 71. These conductors are positioned contiguous with one another to form a second conductor of a pair of electrical conductors extending the length of cable 33 in combination with conductive strands 71. Located within the interior of the ring of conductive filaments 73 is another layer of insulative material 74 within which is located one or more fiberoptic strands forming a core 75. The multiple layers of metal strands and insulative material of course also serve to protect the more delicate fiberoptic strands in the interior of the cable 33.

Figure 9:
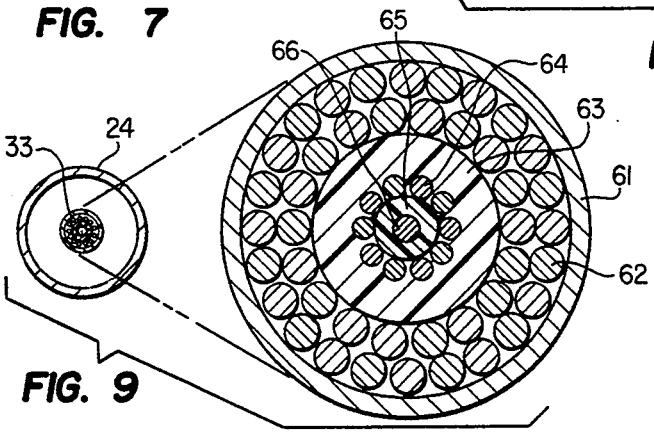
FIG. 9 is an enlarged view of an alternative embodiment of a fiberoptic cable used in connection with the system of the present invention.

Referring now to FIG. 9, there is shown an enlarged, cross-sectional view of the cable 33 shown within the interior of tubing 24 in FIG. 3. As shown, an outer metal shield 61 surrounds a layer of stranded filaments 62 which in turn surround an insulative layer 63. Within the insulation is a second layer of conductive strands 64 which surround an insulative layer 65 within which is contained a fiberoptic core 66. Each of the cables shown in the enlarged views of FIGS. 8 and 9 within the interior of sections of reeled tubing 24 are capable or providing communication within the inspection system described above. Both contain not only a pair of electrically conductive regions for carrying electrical power downhole to the sensor equipment as well as control signals to the equipment but, in addition, a fiberoptic cable comprising one or more optical strands for the transmission of monitored data back uphole from the sensor to the monitoring equipment located at the surface. In addition, the plurality of metal strands within the cable 33 provide strength to the cable and allow it to be provided in extended lengths without undue stress on parts of the cable. The element of the cable shown in FIG. 9 also includes an external metal shield 61 which is particularly useful in the event the fluids flowing within the interior of the tubing 24 comprise highly caustic and/or abrasive fluids which produce injury to the cable without such protection. The materials forming the metal outer shield 61 may include various components such as stainless steel, "Inconel", titanium, and other materials.

Referring again to FIGS. 1 and 2, one method of operation of the system including the cable and tubing configurations of the present invention is as follows. The reeled tubing 24 is positioned above the wellhead of a borehole 12 to be inspected and the reeled tubing injector 25 is used to inject a length of the tubing 24 down the production tubing 17 extending into the borehole. The inspection sensor 31 and the flow control nozzle 32 is carried on the lower end of the reeled tubing 28 into the borehole.

When the lower end of the reeled tubing 28 has reached the location of the inspection zone 15 within the borehole where it is desired to begin inspection, the pumps 42 are used to force an optically clear and/or acoustically homogenous fluid from a supply thereof located at the surface down the length of reeled tubing 24 under control of the pump control unit 44. When a sufficient quantity of optically clear and/or acoustically homogenous fluid 52, as illustrated in region 54 of FIG. 2, has been ejected from the lower end of the reeled tubing 28 so as to create an optically and/or acoustically transparent region 54 in the zone adjacent the inspection sensor assembly 31, inspection is begun. The inspection sensor 31 is enabled by means of the "pill" 54 of homogenous fluid 52 to accurately inspect the conditions within the zone of the transparent region 54 and provide a signal up the fiberoptic cable 33 to the sensor control panel 45 and the sensor monitor 46. At this location, an operator at the surface can accurately monitor the downhole conditions and create a record of the downhole conditions by means of a recording device. With respect to the embodiment shown in FIGS. 1 and 4, at the same time the optically clear and/or homogenous fluid is pumped down the annular region between the outer tubing 24*a* and the outer wall of the inner tubing 24*b*, a second fluid, such as a cooling fluid 36, is pumped down the inner tubing 24 between the inner walls thereof and the outer wall of the fiberoptic cable 33 and circulated through the fluid flow passages 35 within the body of the inspection sensor 31.

Figure 10:
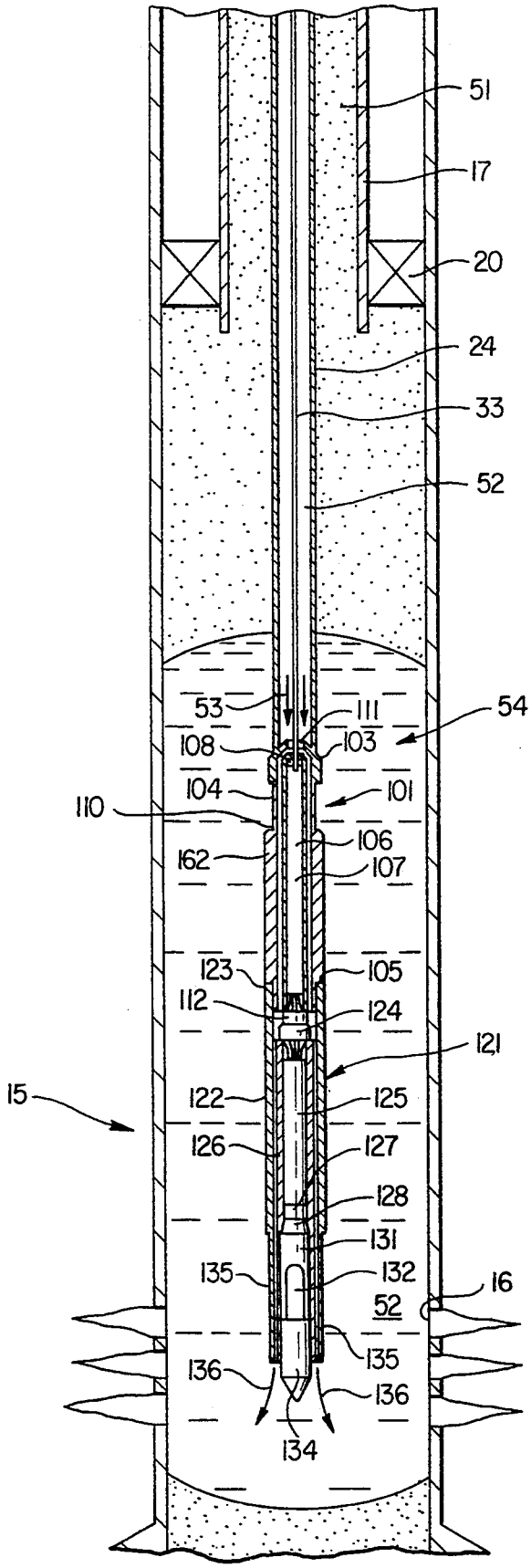
FIG. 10 is an elevational, cross-section view of the lower end of a reeled tubing support for a downhole equipment module constructed in accordance with the teachings of the present invention.

Referring now to FIG. 10, there is shown an enlarged, cross-section view of a reeled tubing support for a downhole equipment module of the present invention. In FIG. 10, the lower end 28 of the reel tubing 24 is positioned in a borehole inspection zone 15. The lower end of the production tubing 17 is sealed on the outside against the inner wall of the casing 14 by means of the production packer 20. Production fluids 51 which flow into the casing 14 through the perforations 16, travel up the tubing 17 toward the wellhead.

As discussed above, one of the pumps 42 are connected to the upper end 43 of the reeled tubing 24 into a supply of fluid. From the surface, optically clear and/or acoustically homogenous fluid 52, from the source connected one of the pumps 42, is pumped down the reeled tubing 24 in the direction of arrows 53 and toward the lower end tubing.

Connected to the lower end of the tubing 24 is a fiberoptic telemetry link assembly 101 comprising an outer housing 102 having an upper attachment flange on a coupling head 103 connected to the lower end of the reeled tubing 24. A reduced section joins the coupling head portion 103 to the outer housing 102 the lower end of which comprises a connecting shoulder 105 for engagement with one of a plurality of possible modular sensing devices, such as the television camera shown. The connection shown for the reception of modular sensor units is a slip fit, o-ring sealed pin connection; however, other types of housing connections may be used. Mounted within the telemetry link 101 on the interior of the outer housing 102 is a circuit chamber 106 which contains a telemetry receiving and transmitting unit 107 which receives information from a sensor and then reduces those data to a modulated optical signal which is transmitted to the surface by means of the fiberoptic conductor located within the interior of fiberoptic cable 33 which is coupled to the transmitter at interface 108. Fiberoptic connectors for use at such interfaces are known and one type of connector is shown in U.S. Pat. No. 4,964,685. The cable 33 also contains electrical conductors to supply power downhole as well as control signals from the surface if needed. The fiberoptic cable may carry numerous channels of information in both directions by providing multiple fibers as well as by multiplexing several signals on each fiber.

Formed within the interior of outer housing 102 in the annular space between the outer wall of the circuit chamber 106 and the inner wall of the housing 102 is an annular fluid passageway 110 surrounding the exterior of the equipment chamber 106. The upper end of the passageway 110 is coupled to a fluid entry aperture 111 which is in fluid flow communication with the interior of the reeled tubing 24 and mounted within the inside of the coupling head 103. On the lower end of the equipment housing 106 in the region of the connecting shoulder 105 there is formed a hermetically sealed connector 112 which is isolated from the flow of fluid around the exterior thereof and through the fluid flow passageway 110.

Shown coupled to the lower end of the telemetry link assembly 101 is a television camera sensor module 121 mounted within an outer housing 122 the upper edge of which 123 mounts in slip fitting and sealing engagement with the lower edge 105 of the modular housing 101. A hermetically sealed connector 124 is also coupled to the connector 112 of the telemetry link assembly and couples control and communication circuitry to the interior of housing 122 which contains a television camera equipment chamber 125. The outer walls of the equipment chamber 125 comprising walls 126 are also spaced from the inner walls of the outer housing 122 to form a fluid flow passage region which is coupled to the fluid flow passageway 110 in the telemetry link assembly 101. This allows a continuity of flow from the interior of the reeled tubing 24 along the space between the modular connector 101 and through the television equipment module 121. A wide angle adjustable lens 127 is positioned at the lower end of the camera behind a pressure sealed transparent layer separating the television camera from a light housing chamber 131. A light bulb having an opaque coating on its upper end to prevent light from shining directly into the camera lens within the changer 131 is provided for illumination of the walls within the borehole through transparent windows 132. The pressure vessel 134 includes the lamp connections for powering of the lamp. The pressurized lamp housing 134 is positioned in the front of the television camera by a plurality of tubular struts 135 which are hollow and connected to the lower ends of the fluid flow passageways 126 within the equipment housing 122. This allows the flow of fluid out the lower end of the tubular housings in the direction of arrows 136 and well in front of the camera lens which allows it to then flow back upwardly in the borehole and insure that there is a region of clear fluid directly in the optical inspection path of the television camera.

Various types of sensor modules can be coupled to the telemetry module, such as pressure, temperature, etc. Even fiberoptic sensors, such as shown in U.S. Pat. No. 4,924,870, could be adapted in appropriate designs.

As can be seen, the optically transparent and/or acoustically homogenous material 52 flowing down the interior of the tubing 24 in the direction of arrows 53 pass into the fluid entry aperture 111 and through the passageway 110 within the fiberoptic telemetry link assembly 101, through the region surrounding the hermetically sealed connectors 112 and 124 through the passageway 126 surrounding the television camera circuitry, and out the lower ends of the mounting tubes 135 to form the optically transparent and/or acoustically homogenous bubble 54 in the region of the television camera to allow enhanced inspection.

It should be noted that while a television camera 121 has been shown as the exemplary modular sensor coupled to the lower end of the telemetry link 101, other modular sensing devices could be employed such as temperature sensors pressure sensors, acoustic sensors and/or others which could function desirably within the region of the optically transparent and/or acoustically homogenous bubble 54. In addition, it can be seen that the fluid 52 is used not only to create the bubble 54 but also to serve to cool the equipment within the transmitter circuitry 107 as well as the television camera 125 and insure that they operate at an appropriate temperature to provide maximum efficiency and operational accuracy. In addition, it should be noted that the transparent fluid 52 exits at the lower end of the entire assemblage through the lower ends of the tubes 135. This is well forward of the sensor to give enhanced functional results. The fluid is then allowed to move back uphole so that a more desirable pattern of optically transparent fluid is created in the region of the sensor.

It is thus believed that the operation and construction of the present invention will be apparent from the foregoing discussion. While the method, apparatus and system shown and described has been characterized as being preferred, it would be obvious that various changes and modifications may be made therein without departing from the spirit and scope of the invention as defined in the following claims.

What is claimed is:

1. A system for use in monitoring conditions within a borehole, comprising:

a length of conduit extending from the surface through the borehole down to the zone where the monitoring is to occur;

a telemetry link module mounted on the lower end of the conduit for transmitting information to the surface, said telemetry link module having means positioned at its lower end for receiving a sensor module and coupling information produced by said sensor module into said telemetry link;

a communication cable connected between the telemetry link and the surface extending through the length of conduit;

means for pumping from the surface down the conduit into the monitoring region adjacent the telemetry link a fluid which provides a medium conducive to accurate inspection of the conditions within the borehole by the sensor module;

a sensor module couple to the receiving means of said telemetry link module, said sensor module including an outer housing, an inner equipment chamber and a passageway therebetween coupled for fluid communication with a passageway within said telemetry link module and receiving the flow of fluid pumped from the surface to cool said sensor module; and of tubular struts attached to the end of said outer housing of said sensor module opposite said telemetry link module, each of said struts having one end in fluid communication with the passageway within said sensor module housing and the other end open to discharge fluid flowing therethrough into the borehole being inspected.

2. A system for use in monitoring conditions within a borehole, comprising:

a length of conduit extending from the surface through the borehole down to the zone where the monitoring is to occur;

a telemetry link module mounted on the lower end of the conduit for transmitting information to the surface, said telemetry link module having means positioned at its lower end for receiving a sensor module and coupling information produced by said sensor module into said telemetry link;

a communications cable connected between the telemetry link and the surface extending through the length of conduit;

means for pumping from the surface down the conduit into the monitoring region adjacent the telemetry link a fluid which provides a medium conducive to accurate inspection of the conditions within the borehole by the sensor module;

a sensor module coupled to the receiving means of said telemetry link module, said sensor module including an outer housing, an inner equipment chamber and a passageway therebetween coupled for fluid communication with a passageway within said telemetry link module and receiving the flow of fluid pumped from the surface to cool said sensor module;

a plurality of tubular struts, attached to the end of said outer housing of said sensor module opposite said telemetry link module, each of said struts having one end in fluid communication with the passageway within said sensor module housing and the other end open to discharge fluid flowing therethrough into the borehole being inspected: and wherein said sensor module comprises a television camera and which also includes a pressurized lamp chamber positioned between said tubular struts, said chamber having transparent windows therein and containing a lamp for illumination of the walls of the borehole being inspected.

3. A system for use in inspecting the interior of a borehole comprising:

a reeled tubing unit including a reel having a length of tubing wound thereon and an injector for inserting the tubing on the reel down into a borehole to a location at which inspection is to occur;

a telemetry link module mounted to the end of the reeled tubing to be inserted into the borehole, said telemetry link being capable of receiving a sensor coupled to the lower end thereof and receiving data from said sensor and transmitting it to the surface;

a fiberoptic cable connected between said telemetry link module and monitoring equipment at the surface;

a pump connected to the end of the reeled tubing located at the surface for supplying pressurized optically transparent and/or acoustically homogenous fluid to the reeled tubing;

means for passing said fluid through said telemetry link module to cool the circuits therein and then to the interior of said borehole to provide an optically clear and/or acoustically homogenous region within the borehole in the region of the sensor and enable the sensor to accurately inspect physical conditions within the borehole;

wherein said telemetry link module includes an outer housing, an inner equipment chamber, and a passageway therebetween for receiving said flow of fluid therethrough for the cooling of equipment therein and said passageway is connected to said reeled tubing to receive the flow of fluid pumped from the surface; and a sensor module coupled to the lower end of said telemetry link module, said sensor module including an outer housing, an inner equipment chamber and a passageway therebetween coupled for fluid communication with the passageway within said telemetry link module and receiving the flow of fluid pumped from the surface to cool said sensor module, said outer housing of said sensor module having attached to the end thereof opposite said telemetry link module a plurality of tubular struts extending from said sensor module, each of said struts having one end in fluid communication with the passageway within said sensor module housing and the other end open to discharge fluid flowing therethrough into the borehole being inspected.

4. A system for use in inspecting the interior of a borehole, comprising:

a reeled tubing unit including a reel having a length of tubing wound thereon and an injector for inserting the tubing on the reel down into a borehole to a location at which inspection is to occur;

a telemetry link module mounted to the end of the reeled tubing to be inserted into the borehole, said telemetry link being capable of receiving a sensor coupled to the lower end thereof and receiving data from said sensor and transmitting it to the surface;

a fiberoptic cable connected between said telemetry link module and monitoring equipment at the surface;

a pump connected to the end of the reeled tubing located at the surface for supplying pressurized optically transparent and/or acoustically homogenous fluid to the reeled tubing;

means for passing said fluid through said telemetry link module to cool the circuits therein and then to the interior of said borehole to provide an optically clear and/or acoustically homogenous region within the borehole in the region of the sensor and enable the sensor to accurately inspect physical conditions within the borehole;

wherein said telemetry link module includes an outer housing, an inner equipment chamber, and a passageway therebetween for receiving said flow of fluid therethrough for the cooling of equipment therein and said passageway is connected to said reeled tubing to receive the flow of fluid pumped from the surface;

a sensor module coupled to the lower end of said telemetry link module, said sensor module including an outer housing, an inner equipment chamber and a passageway therebetween coupled for fluid communication with the passageway within said telemetry link module and receiving the flow of fluid pumped from the surface to cool said sensor module, said outer housing of said sensor module having attached to the end thereof opposite said telemetry link module a plurality of tubular struts extending from said sensor module, each of said struts having one end in fluid communication with the passageway within said sensor module housing and the other end open to discharge fluid flowing therethrough into the borehole being inspected; and wherein said sensor module comprises a television camera and which also includes a pressurized lamp chamber positioned between said tubular struts, said chamber having transparent windows therein and containing a lamp for illumination of the walls of the borehole being inspected.

* * * * *